US006974026B2

(12) United States Patent
Chan et al.

(10) Patent No.: US 6,974,026 B2
(45) Date of Patent: Dec. 13, 2005

(54) THREE-IN-ONE ART PACK

(75) Inventors: Cecil Shu On Chan, Hong Kong (HK); Tak Ko Wong, Hong Kong (HK)

(73) Assignee: T. K. Wong & Associates Ltd., Chiawan (HK)

( * ) Notice: Subject to any disclaimer, the term of this patent is extended or adjusted under 35 U.S.C. 154(b) by 402 days.

(21) Appl. No.: 10/336,044

(22) Filed: Jan. 3, 2003

(65) Prior Publication Data

US 2003/0159951 A1 Aug. 28, 2003

(30) Foreign Application Priority Data

Feb. 25, 2002 (GB) ..... 0204324

(51) Int. Cl.[7] ..... B65D 69/00; B65D 11/34
(52) U.S. Cl. ..... 206/224; 206/214
(58) Field of Search ..... 206/214, 215, 206/224, 226, 537, 371, 409; 401/52, 88, 214

(56) References Cited

U.S. PATENT DOCUMENTS 2,134,570 A * 10/1938 Meilner ..... 401/94
3,963,358 A * 6/1976 Houser ..... 401/195
4,030,842 A * 6/1977 White et al. ..... 401/195
4,573,571 A * 3/1986 Leem ..... 206/214
4,812,069 A * 3/1989 White et al. ..... 401/195
4,872,775 A * 10/1989 Chang ..... 401/52
4,963,048 A * 10/1990 Thomas et al. ..... 401/195
4,972,947 A * 11/1990 McCarthy ..... 206/214
4,989,734 A * 2/1991 Mode et al. ..... 206/575
4,989,801 A * 2/1991 Thomas et al. ..... 242/588
4,991,299 A * 2/1991 Dietterich et al. ..... 30/453
5,002,182 A * 3/1991 McGinnis ..... 206/214
5,009,336 A * 4/1991 Liaw ..... 211/69.1
5,082,119 A * 1/1992 Bingley ..... 211/4
5,522,498 A * 6/1996 Chang ..... 206/214
5,551,787 A * 9/1996 Rosenthal ..... 401/50
5,944,436 A * 8/1999 Huang ..... 401/109
6,098,793 A * 8/2000 Jaksha ..... 206/214
6,123,476 A * 9/2000 Rosenthal ..... 401/51
6,135,661 A * 10/2000 Houser ..... 401/195
6,283,661 B1 * 9/2001 Connors ..... 401/195

FOREIGN PATENT DOCUMENTS

JP 06180318 A * 6/1994

* cited by examiner

*Primary Examiner*—Mickey Yu
*Assistant Examiner*—Faye Francis

(57) ABSTRACT

A storage device for writing or drawing implements includes a holder adapted to receive writing or drawing implements. A paper roll is wrapped around the holder. A guide is positioned adjacent to the paper roll and against which the paper can bear. A base is attached to the holder. Rotation of the base effects rotation of the holder and dispensation of paper from the roll past the guide. A sharpener is located in the base of the device.

12 Claims, 3 Drawing Sheets

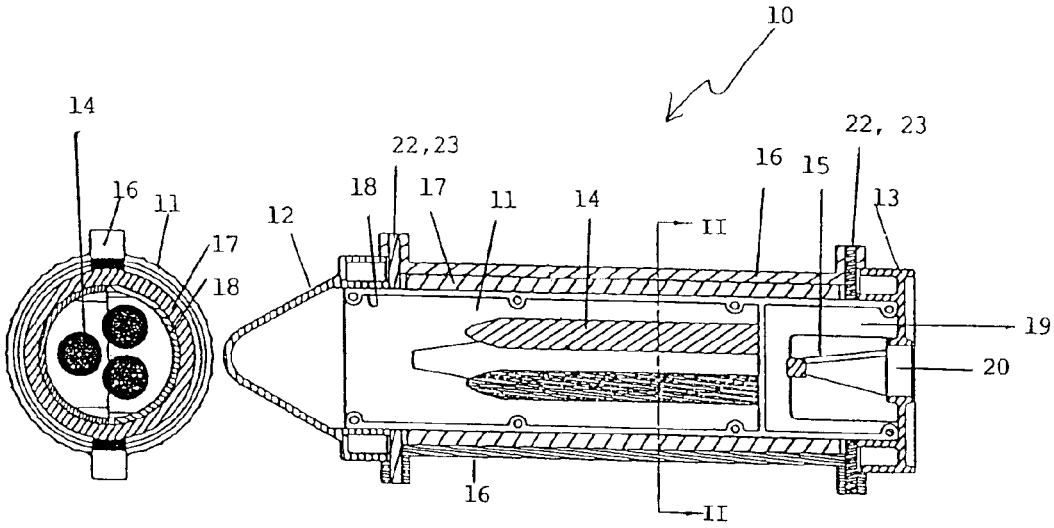
FIGURE 2
FIGURE 1
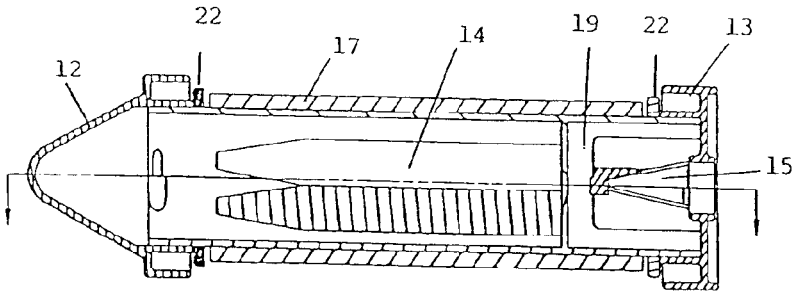
FIGURE 3
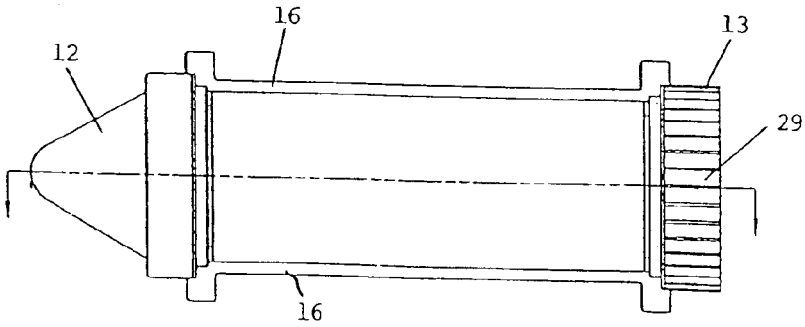
FIGURE 4

THREE-IN-ONE ART PACK

BACKGROUND OF THE INVENTION

The present invention relates to a storage device for writing or drawing implements. More particularly, though not exclusively, the invention relates to a three-in-one art pack for crayons and having a built-in paper roll and sharpening device.

It is common for children to carry pens, pencils, pencil sharpeners, erasers and other items in standard pencil cases. A small pad of writing or drawing paper might also be carried in a pencil case, but writing pads are usually too large to fit within a pencil case.

Pencil sharpeners or crayon sharpeners are usually a separate item carried within the pencil case. Children often leave pencil shavings inside the pencil case, making for a very messy affair.

OBJECTS OF THE INVENTION

It is an object of the present invention to overcome or substantially ameliorate at least one of the above disadvantages and/or more generally to provide an improved storage device for writing implements.

It is a further object of the present invention to provide an improved storage device for writing or drawing implements, also serving to dispense a writing or drawing medium.

DISCLOSURE OF THE INVENTION

There is disclosed herein a storage device for writing or drawing implements, the device comprising:

a holder adapted to receive writing or drawing implements, the holder being elongate and having a longitudinal axis, a media roll wrapped around the holder about said longitudinal axis, a guide positioned adjacent to the media roll and against which the media can bear, and a base attached to the holder, wherein:

rotation of the base about said longitudinal axis effects rotation of the holder and dispensation or retraction of media past the guide from or to the media roll.

Preferably the holder is formed as a pair of half-shell pieces.

Preferably a sharpening device is located within the base.

Preferably the sharpening device includes a number of blades which are fixed with respect to the base and an opening through which the writing or drawing implement can be inserted for presentation to the blades, such that upon rotation of the drawing or writing implement with respect to the base, the writing or drawing implement is sharpened by the blades.

Preferably the base includes a shavings compartment.

Preferably the guide is mounted to the storage device in such a manner that it can be held manually to prevent rotation of the guide when the base is rotated.

Preferably the storage device includes a cap.

Preferably cap includes thread by which it is engaged with corresponding thread on the holder.

In one embodiment the cap includes an opening through which the writing or drawing implements can be removed.

Preferably there is located between the base and the holder a ring providing smooth surfaces against which an edge of the media can bear.

Preferably a similar ring is provided between the cap and the holder.

Preferably the rings each include a tab to which the guide is attached.

Preferably there is a pair of said guides and each ring has a pair of diametrically opposed said tabs so as to support said guides in mutually diametrically opposed positions.

BRIEF DESCRIPTION OF THE DRAWINGS

Preferred forms of the present invention will now be described by way of example with reference to the accompanying drawings, wherein:

FIG. 1 is a schematic cross-sectional elevational view of a three-in-one art pack, FIG. 2 is a schematic cross-sectional end-elevational view of the three-in-one art pack of FIG. 1 taken at II—II in FIG. 1, FIG. 3 is another schematic cross-sectional elevational view of the three-in-one art pack, FIG. 4 is a schematic elevational view of the three-in-one art pack.

DESCRIPTION OF THE PREFERRED EMBODIMENT

In the accompanying drawings there is schematically depicted a three-in-one art pack 10: Art pack 10 is typically formed of moulded plastics material and includes a crayon compartment 11 defined by a crayon holder 18 and within which crayons 14 are stored. Instead of crayons, pens, pencils, paintbrushes or other drawing or writing implements can be stored within the compartment 11.

Figure 11:
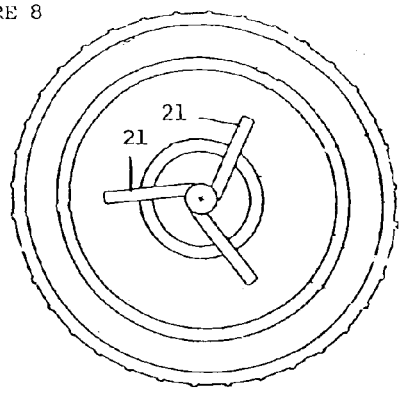
FIG. 11 is a schematic plan view of the base.
Figure 12:
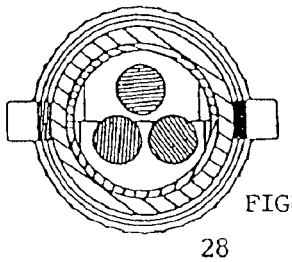
FIG. 12 is a schematic end elevational view of the three-in-one art pack with the cap removed.

The art pack 10 has attached thereto a base 13. Base 13 might be threadedly engaged with the crayon holder 18. Located within the base 13 is a sharpening device 15 and a shavings compartment 19. The sharpening device 15 has formed integrally therewith a number of blades 21 as best illustrated in FIG. 11. As an alternative, the blades 21 might be metallic pieces attached to the base.

Attached to the other end of the crayon holder 11 is a cap 12. Like base 13, 12 might be threadedly engaged with the crayon holder 18.

A pair of paper guides 16 extent longitudinally of the Art pack 10. Located between these guides 16 and the outer surface of the crayon holder 18 there is wrapped a roll of media 17 such as paper.

A pair of rings 22 is provided about the crayon holder 18. One ring 22 is located between the base 13 and the roll 17 and the other ring is located between the cap 12 and the roll of media. These rings serve as a means by which the guides 16 are supported and also as a means for providing a low-friction surface for the edge of the media 17.

Figure 5:
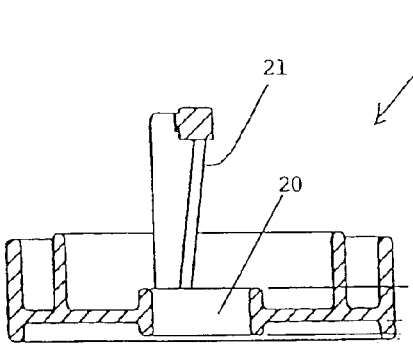
FIG. 5 is a schematic cross-sectional elevational view of the base of the art pack of FIGS. 1 to 4.
Figure 6:
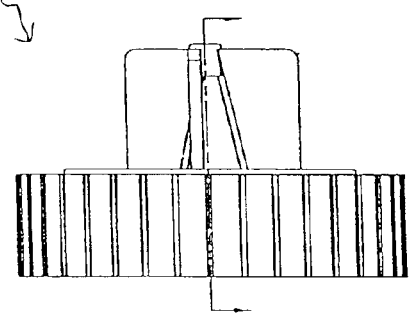
FIG. 6 is a schematic elevational view of the base.
Figure 7:
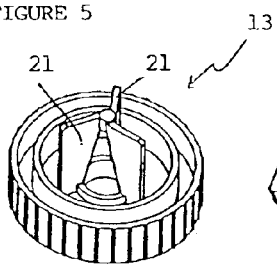
FIG. 7 is a schematic perspective view of the base.
Figure 8:
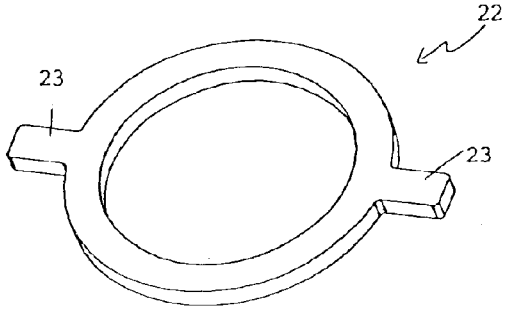
FIG. 8 is a schematic perspective illustration of the ring.
Figure 9:
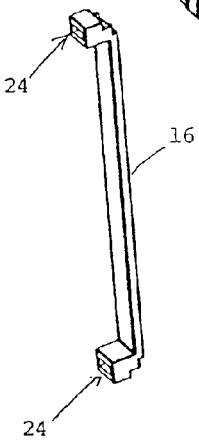
FIG. 9 is a schematic perspective view of a guide piece.
Figure 10:
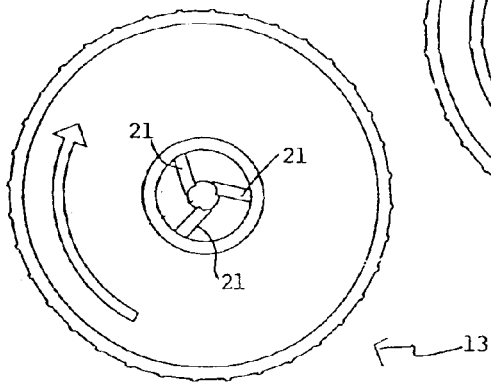
FIG. 10 is a schematic bottom elevation of the base.

As shown in FIG. 8, each ring 22 includes a pair of diametrically opposed tabs 23, which are received within tab recesses 24 in each of the paper guides 16.

Figure 13:
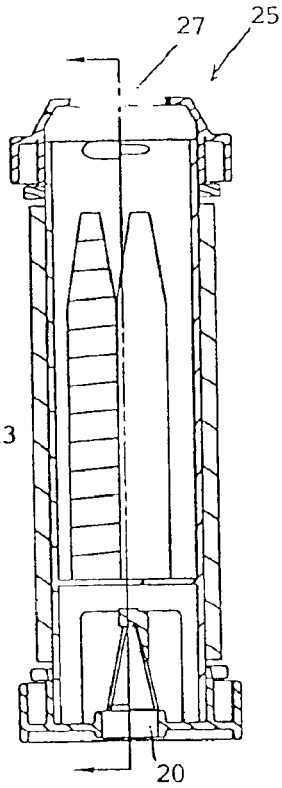
FIG. 13 is a schematic cross-sectional elevational view of an art pack having an alternative cap.
Figure 14:
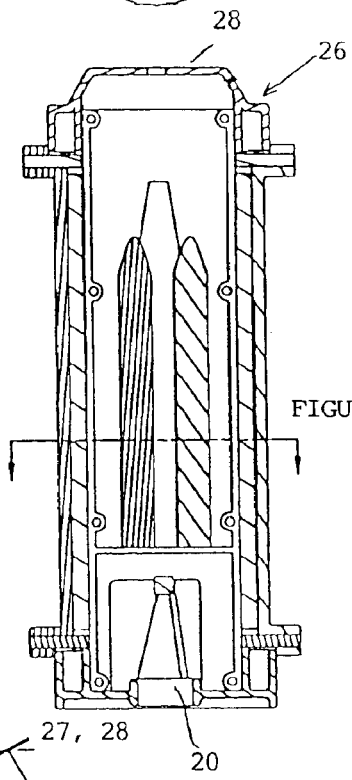
FIG. 14 is a schematic cross-sectional elevational view of an art pack having yet another cap.
Figure 15:
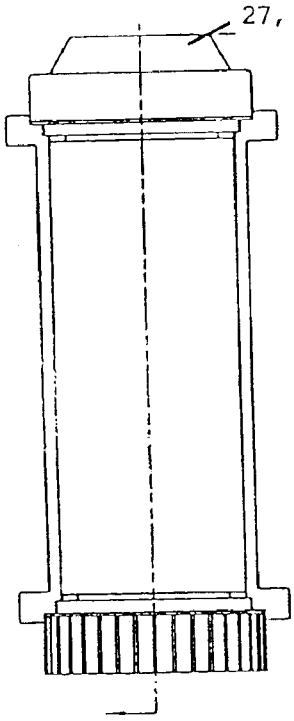
FIG. 15 is a schematic elevational view of the art pack of either one of FIG. 13 or 14.

In the embodiments depicted in FIGS. 1 to 4, the cap 12 has a rounded tip. This cap must be removed to gain access to the crayons 14. In the embodiments depicted in FIG. 13, the cap 25 has a large opening 27 through which the crayons can be removed and inserted. In the embodiment of FIG. 14, the cap 26 has a small hole 28 therein to enable decorative items such as cartoon figurines to be mounted on top of the cap.

In use, the cap 12 is removed to enable one or more of the crayons to be removed. If the crayon or crayons is/are blunt, they can be sharpened by insertion through the opening 20 interface 13 such that the crayon bears against the blades 21. The crayon can then be rotated just like a pencil in a conventional pencil sharpener. The guides 16 can then be grasped and the base 13 can be rotated. To this end, it might be noted that the base 13 can have gripping ribs 29 thereon. To remove the shavings, which have been stored in the shavings compartment, the sharpener can be pulled out and the shavings dispensed with, and the sharpener can then be reattached to the shaving compartment by push-fit for example.

Upon rotation of the base 13, the crayon holder 11 rotates together with the roles 17 of media such as paper. An end of the paper dispenses past the nearest one of the two paper guides 16 and presents itself to be grasped and pulled by the hand that is not grasping the guides. More paper can then be pulled out to be drawn or written upon. The base 13 can be rotated in the opposite or same direction to retract it back for storage past the guide against which it was dispensed.

It should be appreciated that modifications and alterations obvious to those skilled in the art are not to be considered as beyond the scope of the present invention. For example, each paper guide might be provided with a serrated edge to enable a portion of the paper to be torn off. Also, instead of threaded engagement between the cap and the holder, a tight fit or snap fit could be provided.

What is claimed is:

1. A storage device for writing or drawing implements, the device comprising:

a holder adapted to receive writing or drawing implements, the holder being elongate and having a longitudinal axis, wherein the holder is formed as a pair of half-shell pieces, a media roll wrapped around the holder about said longitudinal axis, a guide positioned adjacent to the media roll and against which the media can bear, and a base attached to the holder, wherein:

rotation of the base about said longitudinal axis effects rotation of the holder and dispensation or retraction of media past the guide from or to the media roll.

2. The storage device of claim 1 wherein the guide is mounted to the storage device in such a manner that it can be held manually to prevent rotation of the guide when the base is rotated.

3. The storage device of claim 1 including a cap attached to the holder.

4. The storage device of claim 3 wherein the cap includes thread by which it is engaged with corresponding thread on the holder.

5. The storage device of claim 3 wherein the cap includes an opening through which the writing or drawing implements can be removed.

6. The storage device of claim 1 wherein there is located between the base and the media roll a ring providing smooth surfaces against which an edge of the media roll can bear.

7. The storage device of claim 6 wherein a ring is provided between the cap and the media roll.

8. The storage device of claim 7 wherein the rings each include a tab to which the guide is attached.

9. The storage device of claim 8 wherein there is a pair of guides and each ring has a pair of diametrically opposed tabs so as to support said guides in mutually diametrically opposed positions.

10. A storage device for writing or drawing implements, the device comprising:

a holder adapted to receive writing or drawing implements, the holder being elongate and having a longitudinal axis, a media roll wrapped around the holder about said longitudinal axis, a guide positioned adjacent to the media roll and against which the media can bear, and a base attached to the holder, wherein a sharpening device is located within the base, and wherein:

rotation of the base about said longitudinal axis effects rotation of the holder and dispensation or retraction of media past the guide from or to the media roll.

11. The storage device of claim 10 wherein the sharpening device includes a number of blades which are fixed with respect to the base and an opening through which the writing or drawing implement can be inserted for presentation to the blades, such that upon rotation of the drawing or writing implement with respect to the base, the writing or drawing implement is sharpened by the blades.

12. The storage device of claim 10 wherein the base includes a shavings compartment.

* * * * *